US011053885B2

(12) United States Patent
Luz et al.

(10) Patent No.: US 11,053,885 B2
(45) Date of Patent: Jul. 6, 2021

(54) COOLING CHANNEL HAVING DAM AND FUNNEL

(71) Applicant: KS Kolbenschmidt GmbH, Neckarsulm (DE)

(72) Inventors: Gerhard Luz, Nordheim (DE); Ingo Roth, Pfedelbach (DE); Eberhard Weiss, Langenbrettach (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 0 days.

(21) Appl. No.: 16/470,642

(22) PCT Filed: Dec. 19, 2017

(86) PCT No.: PCT/EP2017/083578
§ 371 (c)(1),
(2) Date: Jun. 18, 2019

(87) PCT Pub. No.: WO2018/114969
PCT Pub. Date: Jun. 28, 2018

(65) Prior Publication Data

US 2019/0323450 A1 Oct. 24, 2019

(30) Foreign Application Priority Data

Dec. 19, 2016 (DE) ..... 102016124804.5

(51) Int. Cl.
*F02F 3/22* (2006.01)
*B21K 1/18* (2006.01)
(Continued)

(52) U.S. Cl.
CPC ..... *F02F 3/22* (2013.01); *B21K 1/185* (2013.01); *F01P 3/10* (2013.01); *F01P 7/14* (2013.01); *F02F 2200/04* (2013.01)

(58) Field of Classification Search
CPC ..... B21K 1/185; F01P 3/10; F01P 7/14; F02F 2200/04; F02F 3/22
See application file for complete search history.

(56) References Cited

U.S. PATENT DOCUMENTS 9,238,283 B2 1/2016 Gniesmer
9,670,871 B2 6/2017 Ottliczky et al.
(Continued)

FOREIGN PATENT DOCUMENTS

CN 106337754 A 1/2017
DE 10 2011 007 285 A1 10/2012
(Continued)

OTHER PUBLICATIONS

DE102011007285 machine translation.*

*Primary Examiner* — Phutthiwat Wongwian
*Assistant Examiner* — Diem T Tran
(74) *Attorney, Agent, or Firm* — Young Basile Hanlon & MacFarlane, P.C.

(57) ABSTRACT

A piston for an internal combustion engine includes a piston upper part and a piston lower part having a cooling channel including at least one inlet opening. A dam-type elevation is formed in the region of the at least one inlet opening through forging of the dam elevation in the cooling channel portion in the piston lower part. In one example, a funnel-shaped inlet contour is formed in the inlet opening by pre-forging. In one example, a V-shaped element is formed in the piston upper part cooling chamber portion in alignment with the inlet opening and used as a coolant jet splitter.

17 Claims, 5 Drawing Sheets

(51) Int. Cl.
*F01P 3/10* (2006.01)
*F01P 7/14* (2006.01)

(56) References Cited

U.S. PATENT DOCUMENTS

| | | | | |
|---|---|---|---|---|
| 9,989,008 | B2 * | 6/2018 | Muller | F02F 3/003 |
| 2017/0030291 | A1 * | 2/2017 | Muller | F02F 3/22 |
| 2017/0051703 | A1 | 2/2017 | Lormes et al. | |
| 2018/0326477 | A1 | 11/2018 | Muller | |

FOREIGN PATENT DOCUMENTS

| | | | |
|---|---|---|---|
| DE | 102012216367 | A1 | 3/2013 |
| DE | 10 2015 206 375 | A1 | 10/2015 |
| FR | 2839116 | A1 | 10/2003 |
| JP | 2003307153 | A | 10/2003 |

* cited by examiner

COOLING CHANNEL HAVING DAM AND FUNNEL

CROSS-REFERENCE TO RELATED APPLICATIONS

This application is a national stage application, filed under 35 U.S.C. § 371, of International Patent Application No. PCT/EP/2017/083578 filed Dec. 19, 2017, which claims priority to German Patent Application No. 10 2016 124 804.5 filed Dec. 19, 2016, both of which are incorporated herein by reference in their entirety.

TECHNICAL FIELD

The invention relates to a piston for an internal combustion engine.

BACKGROUND

From DE 10 2011 007 285 A1 there is known a piston for an internal combustion engine, having an upper piston part and a lower piston part, which piston has an internal, preferably annular cooling channel for cooling the piston during operation of the internal combustion engine. On the lower piston part there is provided at least one inlet opening and at least one outlet opening, via which an inflow of coolant and an outflow of coolant into and out of the cooling channel takes place. Each opening is surrounded by an annular bead or a ramp-like elevation, which prevents the coolant level from falling below a predefined level. The annular bead or the ramp-like elevation is formed in one piece with the lower piston part.

Alternatively to the formation of the annular bead around the opening, DE 10 2015 206 375 A1 discloses, for maintaining a certain coolant level in the cooling channel, that, after the inflow or discharge opening has been produced, a pipe is inserted into that opening, wherein the outlet opening of the pipe, which points in the direction towards the cooling channel, is arranged above the lowermost point of the cooling channel. In this manner too, a certain coolant level is established in the cooling channel. This solution requires a further part and also a further assembly step, and so it is unsuitable in practice.

SUMMARY

The object underlying the invention is to provide a piston having a cooling channel which is improved in respect of its cooling action as compared with the known pistons having cooling channels. This object is achieved by the features of patent claim 1.

The invention relates to a piston, consisting of an upper part and a lower part which are joined together, having a cooling channel, preferably an annularly encircling cooling channel, wherein at least one intake opening is provided for the purpose of supplying cooling oil and at least one discharge opening is provided for the purpose of discharging the cooling oil, according to the features of the preamble of patent claim 1.

The mentioned intake or discharge opening extends from an inner region of the piston in the direction towards the cooling channel and passes through the lower wall, in particular the bottom apex of the cooling channel. Consequently, the opening is situated at the lowest point of the cooling channel, so that cooling oil, at least when the piston is stopped, always flows out of the cooling channel and cannot be kept therein.

According to the invention, it is provided that both a dam-like elevation is formed in the region of the intake and/or discharge opening by a finish forged contour of the lower cooling channel region, and, on the inside of the piston, the inlet contour of the intake and/or discharge opening is formed by pre-forging. As a result, contours that allow a minimum level to be maintained in the cooling channel (in particular when the piston is stopped) can be produced directly in a forging process when the upper portion of the piston lower part, which is produced independently of the lower portion of the piston upper part, is produced. Production by forging has the advantage of a high-strength joint and flow lines that are appropriate to the type of stress, so that a high-strength upper portion of the piston lower part is formed which already has the required contours for performing its function.

In a development of the invention, the pre-forging at the intake opening is funnel-shaped, whereas on the discharge side (that is to say in the region of the discharge opening) it is additionally or alternatively in cylindrical form.

In a development of the invention, in the production of the upper portion of the piston lower part, a dam is produced (formed) as the dam-like elevation during forging, which dam extends over the width of the cooling channel (that is to say extends radially outwards from the direction of the mid-point of the piston, through which the stroke axis of the piston runs), so that flow past the dam-like elevation (dam) in the cooling channel is prevented to the greatest possible extent, whereas in the piston according to DE 10 2011 007 285 A1, flow past is possible. In a development of the invention, the elevation is intended to reach a height of from 20% to 80%, preferably 30% to 70%, of the total height of the cooling channel.

In a development of the invention, the dam (dam-like elevation) produced transversely to the cooling channel has at least one recess, preferably a plurality of recesses, at the transition between the dam and the wall of the cooling channel.

Furthermore, it is additionally or alternatively provided according to the invention that, in the upper piston part of the piston consisting of an upper part and a lower part, the cooling channel is optionally likewise formed by forging and a V-shaped element which projects into the cooling channel is forged in the region of the intake opening, which V-shaped element ensures that the incident oil jet is deflected in both directions of the cooling channel in equal or different amounts. This V-shaped element thus serves as a jet splitter for the incident oil jet which is injected through the intake opening.

As a result of the measures according to the invention, an improved cooling action for the thermally loaded regions of the piston is achieved by the measures implemented at the cooling channel, in that the dam-like elevation ensures that a specifiable coolant level remains in the cooling channel and at the same time does not impede the incoming oil jet by a backflow. Furthermore, the funnel-like form of the intake opening increases the retention rate of the oil that effectively enters the cooling channel.

Furthermore, the funnel-like intake opening serves to trap the oil volume flows of at least two oil jets (delivered by an injection nozzle or more than one injection nozzle) which are parallel or at an angle to one another over extensive regions of the piston stroke and to guide the oil into the cooling channel. The funnel-like forged-on portion can thereby assume all surface forms. The oil provided by the oil injection nozzle can emerge from one or more nozzle openings, wherein not all the nozzle openings have to be opened simultaneously.

Because both contours (both the dam and the funnel) are introduced directly by the forging operation, production of the piston is significantly more efficient, and it is not necessary to use a separate trapping element.

Finally, the shaping of the opposing contours of the dam and the funnel provides the possibility of producing a wall thickness profile which is as uniform as possible, this having a positive effect on the production process and on the weight of the piston, wherein the efficiency of the production of the piston can be increased even further in that the upper side of the cooling channel is likewise produced by a forging process in the upper piston part, and machining or even finish machining is thus largely or completely unnecessary.

Overall, the invention provides an improvement in the cooling action by contours formed integrally on the piston without additional elements. Production of the piston is more efficient as a result, and the processes are simplified. Furthermore, such a piston can be exposed to higher thermal loads while at the same time having a reduced cooling oil requirement.

BRIEF DESCRIPTION OF THE DRAWINGS

An exemplary embodiment of a piston according to the invention is shown in different views in the figures and described in greater detail herein below.

DETAILED DESCRIPTION

Figure 1:
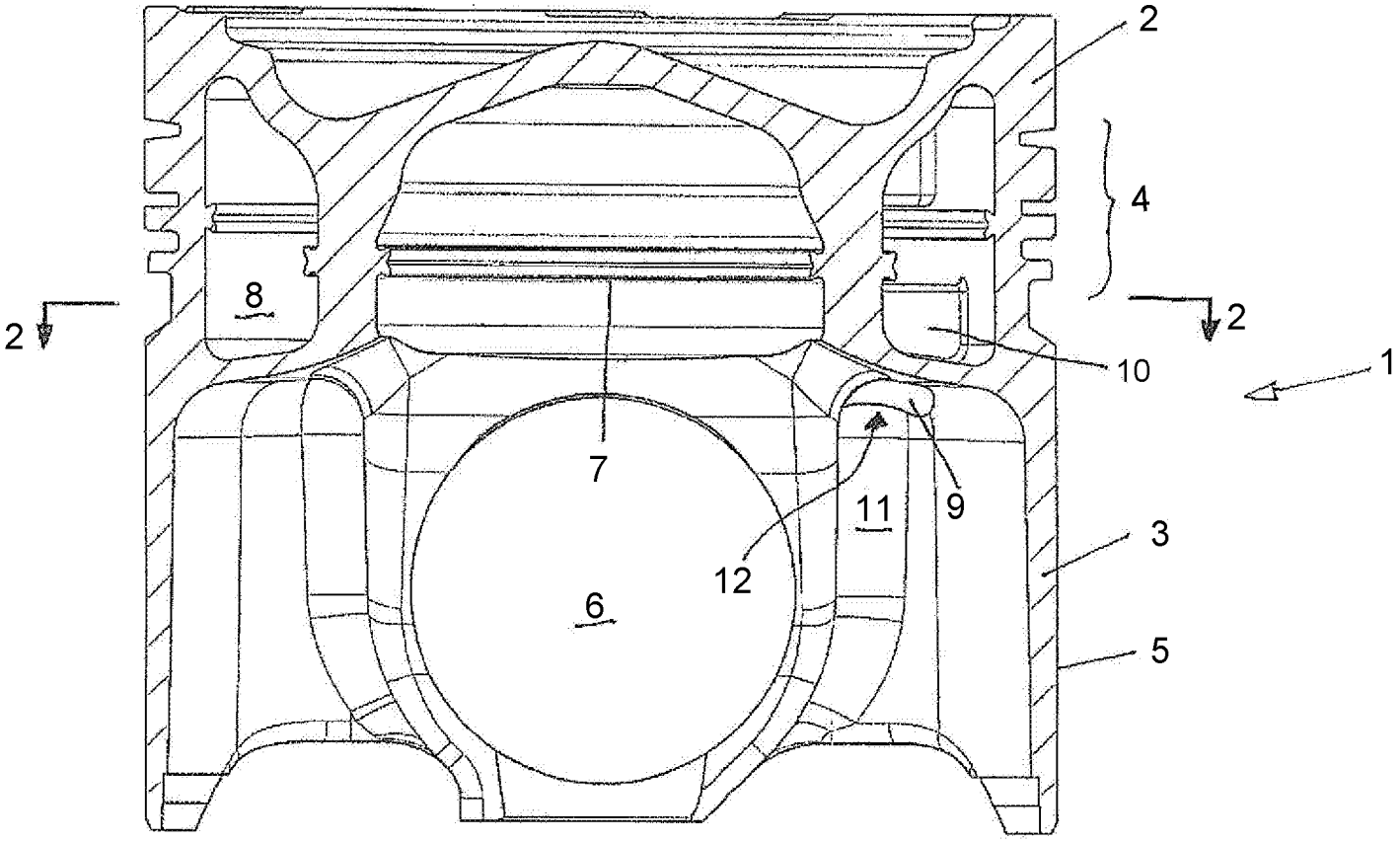
FIG. 1 is a cross-sectional view of an example of a piston of the present invention.

FIG. 1 shows, in section, a piston 1 which consists of a lower part 3 and an upper part 2. The two parts 2, 3 are produced separately from one another and joined together in a suitable manner.

The piston 1 has, in a manner known per se, an outer circumferential annular zone 4 and can contain, but does not have to contain, a combustion bowl.

The lower part 3 forms a piston shaft 5 and a pin bore 6.

Further elements of a functioning piston 1 are present but are not described in detail or provided with reference numerals.

The two parts 2, 3 are connected together permanently and unreleasably by means of a suitable joining operation in order to form a one-piece piston 1 that is ready for use. The joining operation takes place in at least one joining plane 7. In the exemplary embodiment, the joining operation is a friction welding process.

The piston 1 further has a cooling channel 8. In this exemplary embodiment, the cooling channel 8 is formed by part-recesses both in the upper part 2 and in the lower part 3. This has the advantage that, before the two parts 2, 3 are joined together, their part-recesses are accessible and these part-recesses can therefore be optimally produced or finish machined, since they are no longer accessible after the two parts 2, 3 have been joined together.

Likewise in a manner known per se, the piston 1 has at least one intake opening 9 into which a free oil jet, which is delivered by an injection nozzle, is injected in the direction towards the cooling channel 8. If this intake opening 9 is the only opening, it can also serve as a discharge opening for the cooling oil which circulates in the cooling channel 8. Alternatively, at least one further discharge opening, in particular exactly one discharge opening, is present in addition to the at least one or exactly one intake opening 9 (the discharge opening will be described later).

According to the invention, starting from the lower base of the cooling channel 8, a dam-like elevation 10 is present next to the discharge opening 13. This dam-like elevation 10 is formed when the lower part 3 is produced. The lower part 3 can accordingly be produced in a casting process, for example, and the dam-like elevation can be formed during that process. Alternatively, the lower part 3 can be produced in a casting process and then the dam-like elevation 10 can be formed by a forming process (such as, for example, a forging process). Particularly preferably, both the lower part 3 with its geometries and the dam-like elevation 10 are produced in a forming process (such as, for example, a forging process).

When the lower part 3 is produced, this lower part acquires an inside geometry 11 with an in particular funnel-like inlet contour 12 of the intake opening 9. The inlet contour 12 can also have a shape other than a funnel shape. It is important to form the inlet contour 12 preferably in a forging process and thereby give it a shape with which the oil jet injected into the intake opening 9 is guided in a targeted manner in the direction towards the cooling channel 8. It is also important that the dam-like elevation 10 next to the intake opening 9 does not impede the entry of the injected oil jet, so that the injected oil is guided into the cooling channel 8 round the entire circumference.

Figure 2:
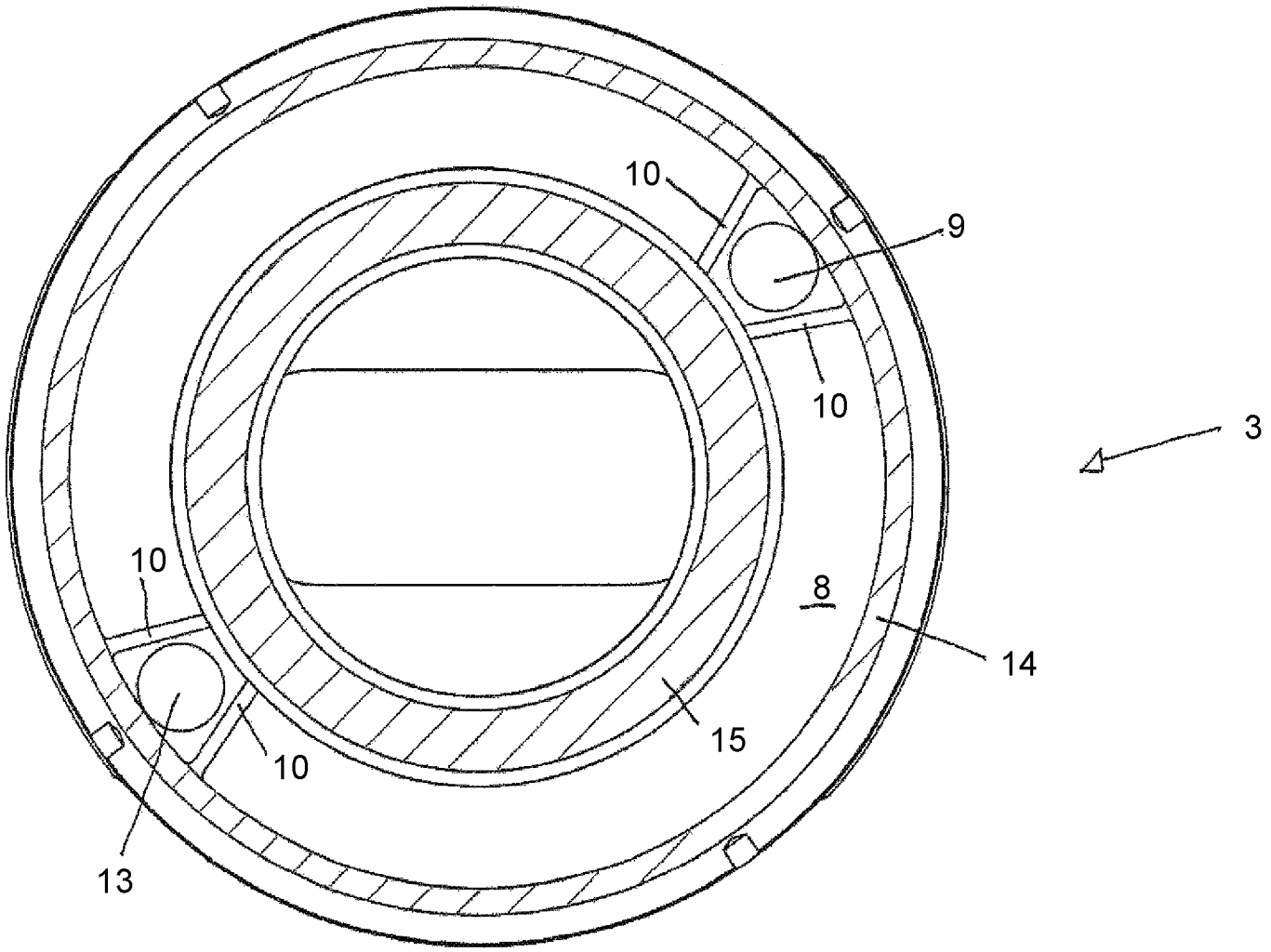
FIG. 2 is a cross-sectional view taken along line 2-2 in FIG. 1.

FIG. 2 shows a plan view of the top side of the lower part 3, which points in the direction towards the upper part 2. It will be seen here that, in addition to an intake opening 9, a discharge opening 13 is also present. In this exemplary embodiment, exactly one intake opening 9 and exactly one discharge opening 13 are present, extending from which an encircling cooling channel 8 is present. It is, however, also conceivable that the cooling channel 8 is formed not around the entire circumference but is divided into, for example, at least two part-segments. In this case, each part-segment, for example, has its own intake opening and its own discharge opening.

As is apparent from the representation in FIG. 2, on each side, in the direction of the cooling channel 8, next to the intake opening 9 and the discharge opening 13, a dam-like elevation 10 is present on the lower part 3 and formed in one piece therewith. It is, however, also conceivable to provide only one dam-like elevation 10 or even no dam-like elevation 10 at all at one of the openings 9, 13, in particular in the region of the discharge opening 13.

It is further apparent from FIG. 2 that the lower part 3 has an outer circumferential joining face 14 and an inner circumferential joining face 15, which are formed by corresponding web portions of the lower part 3. These joining faces 14, 15 point towards corresponding joining faces of the upper part 2, which likewise forms web portions, at the end of which the joining faces are formed. By means of these corresponding joining faces pointing towards one another, the two parts 2, 3 are joined together permanently and unreleasably preferably by means of a friction welding process. Other geometric forms of the two parts 2, 3 and other joining processes which ensure that the two parts 2, 3 are joined together permanently and unreleasably are likewise conceivable.

Figure 3:
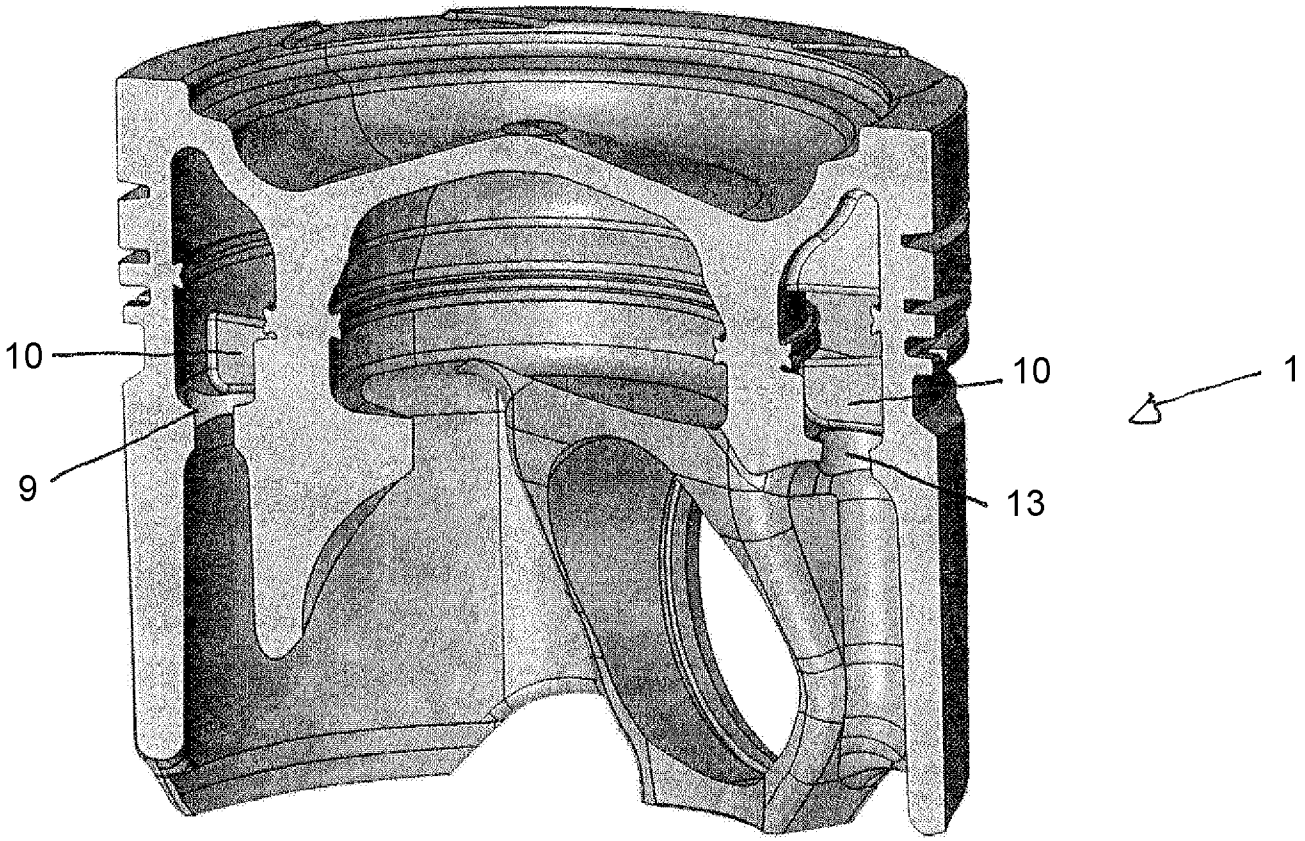
FIG. 3 is a cut-way perspective view of one example of the piston.

FIG. 3 shows the piston 1 in a cutaway, three-dimensional view, in which the two parts 2, 3 have been joined together permanently and unreleasably. Furthermore, the position both of the intake opening 9 with at least one associated dam-like elevation 10 and the position of the discharge opening 13 (in this case also with an associated dam-like elevation 10) can be seen.

Figure 4:
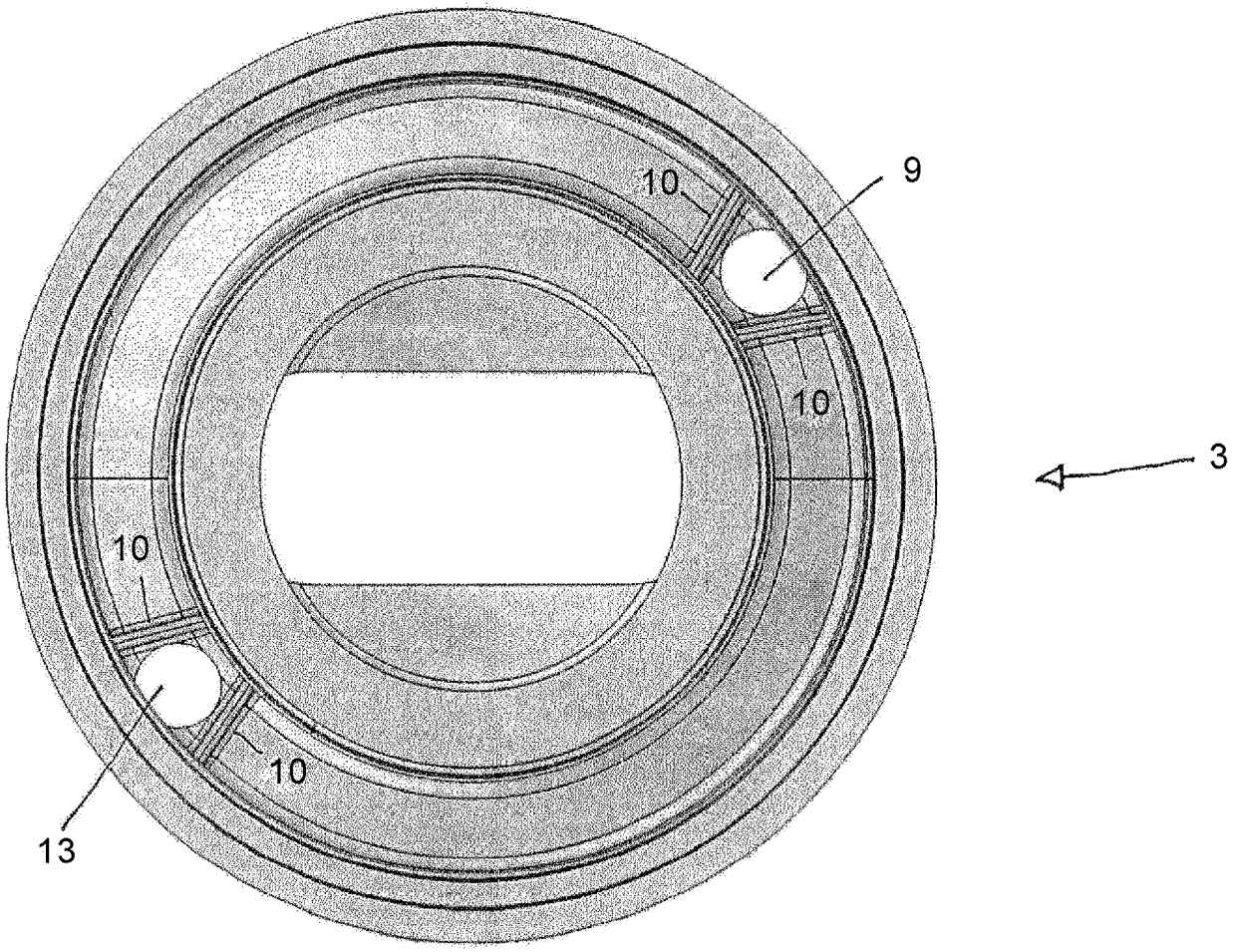
FIG. 4 is a plan view of an example of a piston bottom part top surface

FIG. 4 shows, analogously to the representation in FIG. 2 in a three-dimensional view, a plan view of the lower part 3, wherein, as can also be seen in FIG. 2, a part-region of the cooling channel 8 is formed by the lower part 3.

Figure 6:
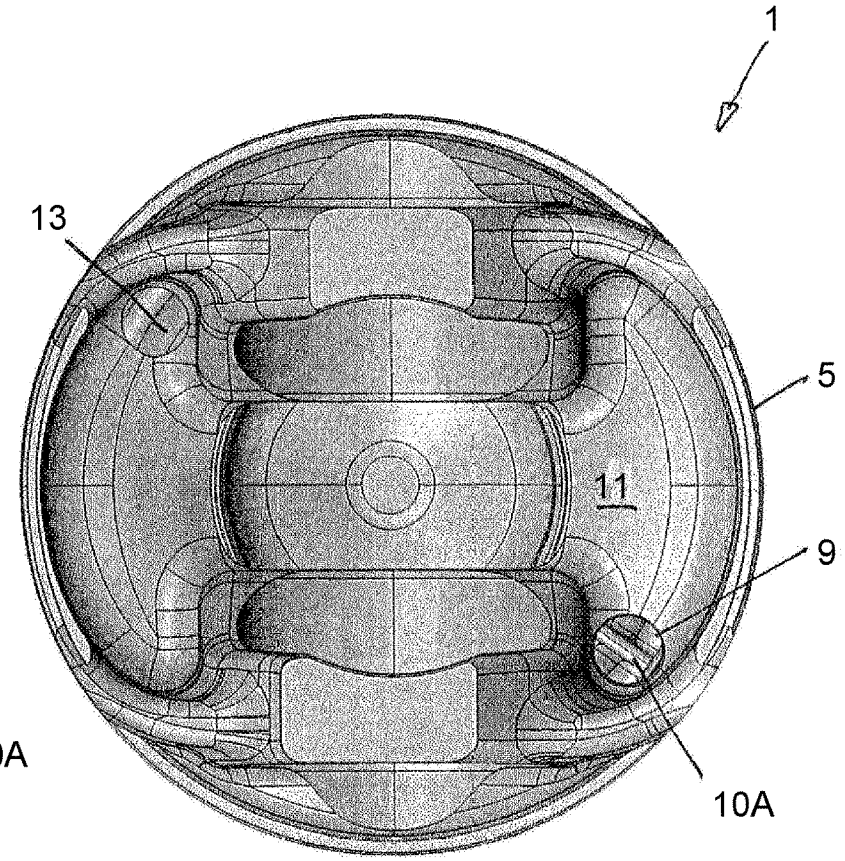
FIG. 6 is a bottom view of an example of a piston.
Figure 5:
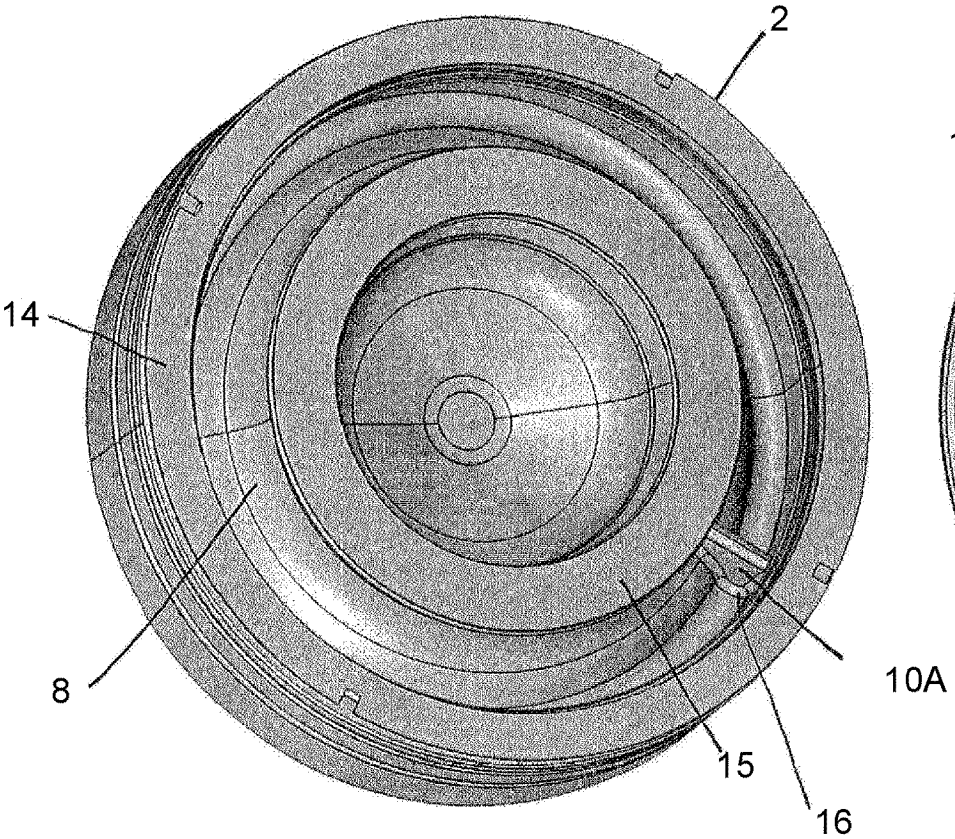
FIG. 5 is a bottom perspective view of an example of a piston upper part.

FIG. 5 shows in a three-dimensional view the bottom side of the upper part 2, which points in the direction towards the lower part 3. In addition to the corresponding joining faces 14, 15, it can be seen that, in the part-region of the cooling channel 8 of the upper part 2, a V-shaped element 10A (for example in the region of the intake opening 9) is likewise formed by the upper part 2. In this case, the V-shaped element 10A is not arranged next to the opening but is situated in the continuation of the cross section of the opening (intake opening 9 and/or discharge opening 13), so that the V-shaped element 10A in the part-region of the cooling channel 8 of the upper part 2 serves as a jet splitter. As best seen in FIG. 6, the V-shaped element 10A is radially and angularly aligned with the intake opening 9 with respect to the piston stroke axis. By means of this jet splitter, the oil jet injected in particular through the at least one intake opening 9 is divided and can be divided in equal or different amounts in both directions of the cooling channel 8.

In FIG. 5 it is additionally also shown that the V-shaped element 10A produced transversely to the cooling channel 8 has at least one recess 16, preferably a plurality of recesses, at the transition between the V-shaped element 10A and the wall of the cooling channel 8, in particular in the apex region of the cooling channel 8. This makes it possible that a portion of the cooling oil which circulates in the cooling channel 8 is always able to circulate therein without being impeded by the V-shaped element 10A.

Finally, FIG. 6 shows the inside geometry 11 of the piston 1, in which the above-described parts 2, 3 have been joined together. In this case, it can be seen that a V-shaped element 10A serving as a jet splitter is provided in the region of the intake opening 9 on the upper part 2 when viewed pointing downwards in the region of the cross section of the intake opening 9. Not visible but present are at least one dam-like elevation 10 in the part-region of the lower part 3 next to the intake opening 9 (and optionally also next to the discharge opening 13).

The orientation of the shown dam like elevation 10 either in the lower part 3 and/or the V-shaped element 10A in upper part 2 is by way of example and extends preferably radially starting from the piston stroke axis. Other radial orientations differing therefrom are of course also conceivable.

LIST OF REFERENCE NUMERALS

1. Piston
2. Upper part
3. Lower part
4. Annular zone
5. Piston shaft
6. Pin bore
7. Joining plane
8. Cooling channel
9. Intake opening
10. Dam-like elevation
10A. V-shaped element
11. Inside geometry (inside)
12. Inlet contour
13. Discharge opening
14. Outer joining face
15. Inner joining face
16. Recess

The invention claimed is:

1. A piston of an internal combustion engine, consisting of an upper part and a lower part which are joined together to form a cooling channel having an intake opening and a discharge opening for a coolant, characterized in that a dam elevation is formed in the cooling channel in a region of at least one of the intake opening or the discharge opening by a finish forged contour of a lower cooling channel region, and the piston upper part further comprising a V-shaped element integrally formed in the piston upper part by forging and extending into the cooling channel, the V-shaped element radially and angularly aligned with the intake opening and operable to split a flow of coolant received through the intake opening toward alternate positions of the coolant channel.

2. The piston of claim 1, wherein on an inside of the piston, the piston lower part further comprises a funnel-shaped inlet contour in communication with the intake opening, the inlet contour formed by pre-forging.

3. The piston of claim 2, further comprising a pre-forging at the discharge opening, wherein the pre-forging at the discharge opening is cylindrically-shaped.

4. The piston of claim 1, wherein the dam elevation is formed during forging of the piston lower part and extends over a width of the cooling channel.

5. The piston of claim 4, wherein the dam elevation comprises a height from 20% to 80% of a total height of the cooling channel.

6. The piston of claim 5 wherein the dam elevation height comprises 30% to 70% of the total height of the cooling channel.

7. The piston of claim 1, wherein the V-shaped element is oriented transversely to the cooling channel and defines at least one recess at a transition between the V-shaped element and a wall of the cooling channel.

8. The piston of claim 7 wherein the at least one recess comprises a plurality of recesses at the transition between the V-shaped element and the wall of the cooling channel.

9. The piston of claim 7, wherein the at least one recess is positioned at an apex of the cooling channel.

10. An internal combustion piston comprising:

A piston upper part defining a portion of a cooling channel having a width oriented radially relative to a piston stroke axis;

a piston lower part connected to the upper part and forming a portion of the cooling channel, the lower part defining a coolant intake opening and a discharge opening in communication with the cooling channel;

a dam elevation positioned in the piston lower part cooling channel portion and extending across the cooling channel width, the dam positioned in a region adjacent to at least one of the intake opening or the discharge opening the dam elevation formed through forging at the time of forming the piston lower part; and a V-shaped element positioned in the piston upper part coolant channel portion and extending into the coolant channel portion, the V-shaped element positioned in radial and angular alignment with the intake opening and operable to split a flow of coolant received through the intake opening toward alternate portions of the coolant channel, the V-shaped element formed by forging at the time of forming the piston upper part.

11. The piston of claim 10 wherein the dam elevation comprises a first dam and a second dam elevation, the first and the second dam elevation positioned on opposing sides of the at least one of intake opening or the discharge opening and operable to maintain a predetermined level of coolant in the cooling channel when movement of the piston is stopped.

12. The piston of claim 11 wherein the piston lower part further comprises a pre-forging funnel-shaped inlet contour leading into the intake opening to aid the flow of coolant through the intake opening into the coolant channel.

13. The piston of claim 11 wherein the first dam elevation and the second dam elevation are positioned on opposing sides of both the inlet opening and the discharge opening.

14. The piston of claim 13 wherein the piston lower part further comprises a pre-forging cylindrical shape contour in communication with the discharge opening.

15. The piston of claim 10, wherein the V-shaped element is oriented transversely to the cooling channel and defines at least one recess at a transition between the V-shaped element and a wall of the cooling channel.

16. The piston of claim 15, wherein the at least one recess is positioned at an apex of the cooling channel.

17. An internal combustion piston comprising:

A piston upper part defining a portion of a cooling channel having a width oriented radially relative to a piston stroke axis;

a piston lower part connected to the upper part and forming a portion of the cooling channel the lower part defining a coolant intake opening and a discharge opening in communication with the cooling channel; and a V-shaped element positioned in the piston upper part coolant channel portion and extending into the coolant channel portion, the V-shaped element positioned in radial and angular alignment with the intake opening and operable to split a flow of coolant received through the intake opening toward alternate portions of the coolant channel, the V-shaped element formed by forging at the time of forming the piston upper part.

* * * * *